United States Patent [19]

Taylor et al.

[11] Patent Number: 4,484,106

[45] Date of Patent: Nov. 20, 1984

[54] UV RADIATION TRIGGERED RAIL-GAP SWITCH

[75] Inventors: Roderick S. Taylor, Ottawa; Kurt E. Leopold, Carp; A. John Alcock, Ottawa, all of Canada

[73] Assignee: Canadian Patents & Development Limited, Ottawa, Canada

[21] Appl. No.: 417,177

[22] Filed: Sep. 10, 1982

[30] Foreign Application Priority Data

May 14, 1982 [CA] Canada ..... 403028

[51] Int. Cl.[3] ..... H01J 7/24

[52] U.S. Cl. ..... 315/150; 315/154; 315/156; 250/372; 250/373

[58] Field of Search ..... 315/150, 154, 156; 250/372, 373

[56] References Cited

U.S. PATENT DOCUMENTS

| | | | |
|---|---|---|---|
| 2,588,789 | 5/1952 | Zinn | 313/622 |
| 3,398,322 | 8/1968 | Guenther | 315/156 |
| 3,524,101 | 8/1970 | Barbini | 315/150 |
| 3,732,453 | 5/1973 | Johnson et al. | 250/423 |
| 4,401,920 | 8/1983 | Taylor et al. | 315/150 |

*Primary Examiner*—Harold Dixon
*Attorney, Agent, or Firm*—Edward Rymek

[57] ABSTRACT

The UV radiation triggered rail-gap switch applies a high voltage from a low impedance source to a low impedance load. The switch includes first and second parallel elongated electrodes spaced to form a uniform gap along their length. The first electrode is adapted to be connected to the high voltage source, while the second electrode is adapted to be connected to the low impedance load. When a voltage from the source is applied to the electrodes, one electrode will be positive relative to the other electrode. In addition, the cross-section of each of the electrodes is sufficiently smooth to prevent points of high field concentration between the electrode. This cross-section is defined by the field enhancement factor of each electrode which is preferably less than 1.5. The switch also includes an enclosure in which the electrodes are located and which contains a gas mixture for maintaining the breakdown threshold between the electrodes. A preferred gas mixture includes Ar, $N_2$, and $SF_6$ at a gas pressure selected to prevent breakdown in the switch until triggered by a UV radiation source. The UV radiation source directs a beam of radiation substantially parallel to the pair of electrodes, preferably near the positive electrode, for initiating multi-channel, sub-nanosecond jitter, breakdown in the gap between the electrodes. The UV radiation may be obtained from either an incoherent radiation source or an UV laser source, but should be of short duration in the form of a narrow beam which is uniform along its cross-section.

27 Claims, 15 Drawing Figures

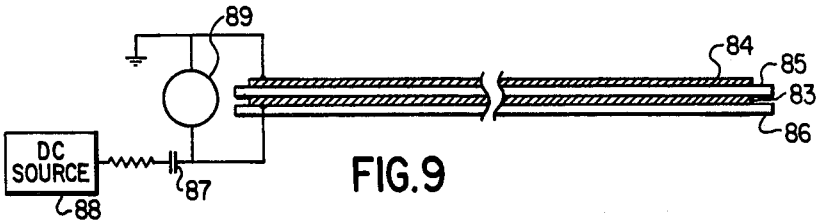
FIG.9
FIG.10
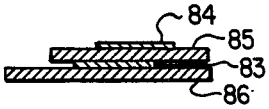
FIG.11
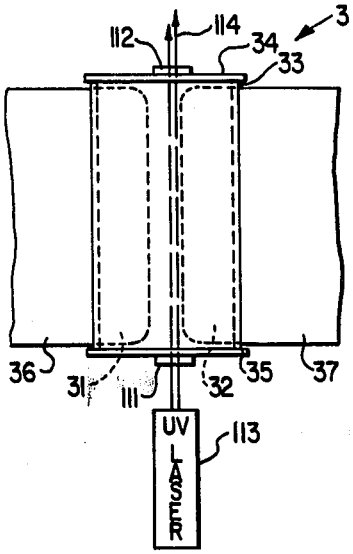
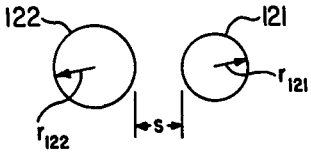
FIG.12
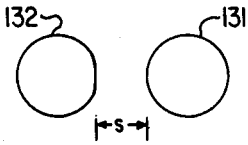
FIG.13

UV RADIATION TRIGGERED RAIL-GAP SWITCH

BACKGROUND OF THE INVENTION

The invention is directed to devices for switching a high voltage into a low impedance load, and in particular, to rail-gap switching devices triggered by a source of UV radiation to provide low jitter multichannel switching.

A number of devices are capable of low inductance, high voltage switch operation, though these devices are presently limited in repetition rate and switch lifetime. Potential devices for high repetition rate switching operation are the three-electrode electrically triggered rail-gap, such as described in the publication, "Multichannel, High Energy Rail-Gap Switch", G. R. Neil et al, Rev. Sci. Instrum., 49, 401, pp. 401–403, 1978; the dc-triggered gas insulated surface spark gap, such as described in the publication, "Triggered Multichannel Surface Spark Gaps", H. M. von Bergmann, J. Phys. E: Sci. Instrum., Vol. 15, pp. 243–247, 1982; magnetic switches, such as described in the publication, "Basis Principles Governing the Design of Magnetic Switches", D. L. Birx et al, Lawrence Livermore Laboratory report UCID-18831, Nov. 18, 1980; and UV radiation triggered rail-gaps, such as described in U.S. patent application Ser. No. 262,685, by R. S. Taylor et al, filed on May 11, 1981, now U.S. Pat. No. 4,401,920 issued Aug. 30, 1983 which corresponds to Canadian Patent Application Ser. No. 353,041, filed May 23, 1980, or in the publication, "Multichannel Switch Triggered by Low Voltage Auxiliary Discharges", D. B. Cohn et al, Review of Sci. Instru., 53(2), Feb. 1982, pp. 253–255.

The electrical triggering of a gas insulated rail-gap consisting of two uniform field electrodes by means of a third knife-edge electrode leads to serious trigger electrode erosion problems. Furthermore, since the technique requires a very fast, high voltage trigger pulse to initiate multichannel breakdown, it is difficult to operate at high repetition rate.

The dc-triggered gas insulated surface spark gap consists of highly non-uniform field electrodes as well as a dielectric surface across which arc-formation occurs. Both of these features will limit the repetition rate and switch lifetime.

On the basis of preliminary results, magnetic switching techniques appear promising for specific applications. However, switch dissipation and switching speed appear to be two limitations of this approach. UV triggering by UV radiation from a laser or corona discharge is a very useful technique for triggering multichannel rail-gaps. However, the present devices do not provide an efficient low jitter operation with the long term reliability and high repetition rate required for commerical high voltage triggering devices.

SUMMARY OF THE INVENTION

It is therefore an object of this invention to provide an efficient, low jitter, low inductance device capable of controlled multichannel switching of high voltages into a low impedance load.

This and other objects are achieved in a rail-gap switch which has first and second parallel elongated electrodes spaced to form a uniform gap along the length of the electrodes. The first electrode is adapted to be connected to the high voltage source, while the second electrode is adapted to be connected to the low impedance load. When a voltage from the source is applied to the electrodes, one electrode will be positive relative to the other electrode. In addition, the cross-section of each of the electrodes is sufficiently smooth to prevent points of high field concentration between the electrodes. This cross-section is defined by the field enhancement factor of each electrode which is less than 1.5. The switch also includes an enclosure in which the electrodes are located and which contains a gas mixture for maintaining the breakdown threshold between the electrodes. A pulsed source of UV radiation directs a uniform cross-section beam of radiation substantially parallel to the pair of electrodes for initiating multichannel breakdown in the gap between the electrodes. The gas pressure is preferably selected such that in the absence of the UV radiation, no breakdown will occur.

In accordance with an aspect of this invention, the UV radiation beam is directed near the positive electrode. In addition, the field enhancement factor f is greater for the positive electrode than for the negative electrode. The positive electrode may be made positive by being connected to a positive voltage source, or by being connected to a positive ground through the load. The electrodes may have a circular or near circular cross-section.

In accordance with another aspect of the invention, the UV radiation source may be incoherent or coherent, however it should have a fast risetime and provide a narrow, uniform cross-section beam. An incoherent radiation source may consist of a corona discharge source located in the switch enclosure and apertured to provide a thin beam near the positive electrode. A coherent radiation source may be a UV laser, such as an ArF laser, KrF laser, XeCl laser or $N_2$ laser. The UV radiation source is preferably timed to trigger the switch as the voltage across the electrodes reaches its maximum value.

In accordance with a further aspect of this invention, the gas mixture may include Ar, $N_2$ and $SF_6$ in ratios in the order of 1:1:.02. When a laser source is used, an organic additive may be included in the gas mixture to improve the level of ionization.

Many other objects and aspects of the invention will become clear from the detailed description of the drawings.

BRIEF DESCRIPTION OF THE DRAWINGS

In the drawings:

FIGS. 8, 9 and 10 illustrate the construction of an incoherent source;

FIG. 11 illustrates a coherent radiation triggered switch;

FIGS. 12 and 13 illustrate the cross-sections of two different pairs of electrodes;

DETAILED DESCRIPTION

Figure 1:
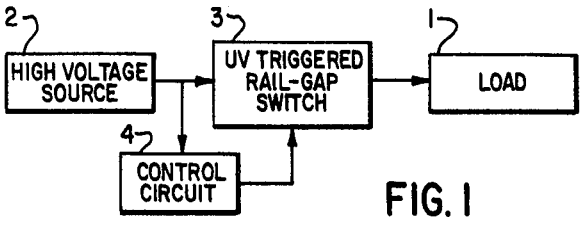
FIG. 1 is a schematic of the system in which the switch is used.
Figure 2:
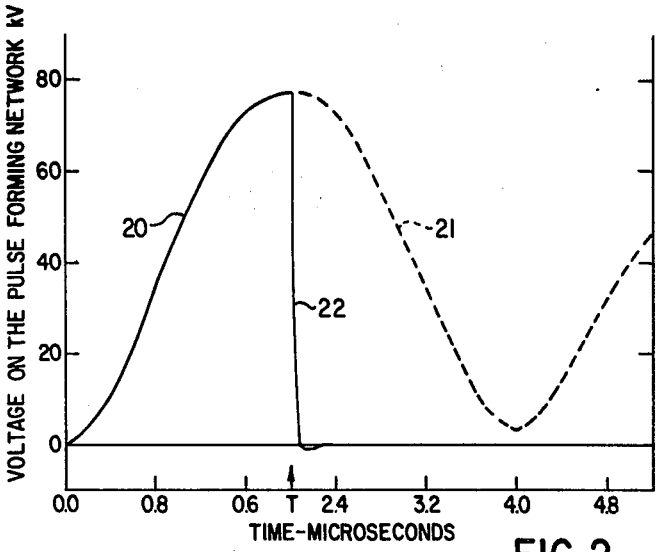
FIG. 2 illustrates the voltage pulse obtained from a source.

FIG. 1 illustrates a system in which a low impedance load 1, such as an excimer laser, is energized. A high voltage source 2, i.e. in the order of 70–80 kV, provides the input power for the load 1. The source 2 may be a pulsed source, i.e. a source which provides a positive or negative voltage pulse having a duration as low as a fraction of a microsecond. In FIG. 2, a pulse of 4 microsecond duration is shown by solid line 20 and broken line 21.

The system further includes a UV triggered rail-gap switch 3, in accordance with the present invention, for applying the source 2 voltage to the load 1, and a control circuit 4 for triggering the switch 3 at the appropriate time relative to the source 2 voltage.

Figure 3:
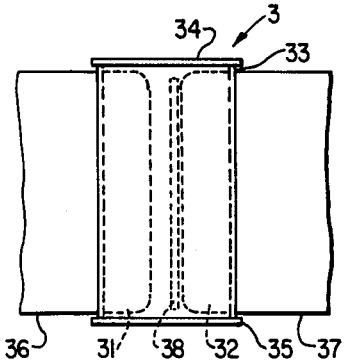
FIGS. 3 and 4 illustrate the basic switch in accordance with the present invention.
Figure 4:
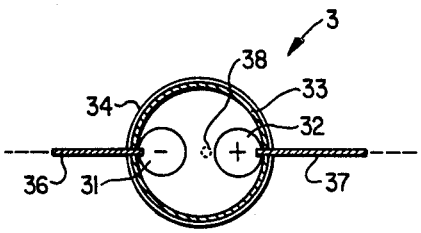

A UV triggered rail-gap switch 3, in accordance with the present invention, is illustrated in FIGS. 3 and 4. The switch 3 includes a pair of elongated electrodes 31 and 32 which are mounted parallel to one another to establish a gap between them. The electrodes 31 and 32 are made from highly conductive material, such as brass. The electrodes 31 and 31 are mounted in a hermetic enclosure 33 which is made of nonconductive material, such as plexiglass, and which has end walls 34 and 35. Each electrode 31 and 32 also has a conductive sheet lead 36, 37, for connecting the switch 3 between the load 1 and the source 2. Conductive leads 36 and 37 may be made from copper.

The cross-section of the electrodes 31 and 32 are designed not to have edges that could create areas with highly concentrated electric fields between the electrode. The field distribution between the electrodes is determined by the field enhancement factor f of each electrode, f being the ratio between the maximum electric stress to the average electric stress between the electrode in question and a conducting plane. In the publication, "Long-Life High Repetition Rate Triggered Spark Gap", by H. Watson, IEEE Transactions on Plasma Science, Vol. PS-8, No. 3, Sept. 1980, pp 154–159, the equation for f, appropriate for two identical cylindrical electrodes has been modified to account for a cylinder-plane electrode geometry and is given as:

$$f = \frac{K_1 S}{r} + K_2, \text{ when } \frac{S}{r} \geqq 0.37$$

where

S is twice the actual electrode separation s in cm., r is the radius of the electrode in cm., and $K_1$ and $K_2$ are constants related to the geometry of the electrodes, for example, $K_1$ is 0.13 and 0.46 for cylindrical and spherical electrodes, respectively, while $K_2$ is 1.06 and 0.83 for cylindrical and spherical electrodes, respectively.

It has been determined that for the switch, in accordance with the present invention, the field enhancement factor f for each electrode should not exceed 1.5 for any one of the electrodes 31 or 32, however that each electrode 31 or 32 may have a different f.

The hermetic enclosure 33 of the rail-gap switch 3 is filled with a mixture of several gases, and has the functions of producing a reproducible high voltage breakdown threshold between the electrodes 31 and 32 and, at the same time, of enhancing multichannel breakdown when breakdown occurs. This is one of the requirements necessary for achieving low jitter in a high power, high repetition rate system. Various mixtures of known gases may be utilized to perform these functions, however, after efficacy, safety, practicality and cost have been taken into consideration, a mixture of $N_2$, Ar and $SF_6$ in the proportion 1:1:0.02 at a total pressure above one atmosphere, was found to be preferred. The electronegative gas $SF_6$ suppresses any corona discharges which might occur before the arrival of the trigger and, therefore, stabilizes the switch breakdown threshold. The Ar encourages multichannelling when discharge occurs. The $N_2$ assists in maintaining a high voltage holdoff between the electrodes and also assists multichannelling operation.

The rail-gap switch 3 is triggered by introducing a beam 38 of UV radiation in the gap between the electrodes 31 and 32, near the electrode which is positive with respect to the other electrode. In FIG. 4, electrode 32 is shown to be positive with respect to electrode 31. Either of the electrodes 31 or 32 may be connected to the load 1 or the source 2, and the source may either be positive or negative, with negative or positive system grounds respectively.

Figure 5:
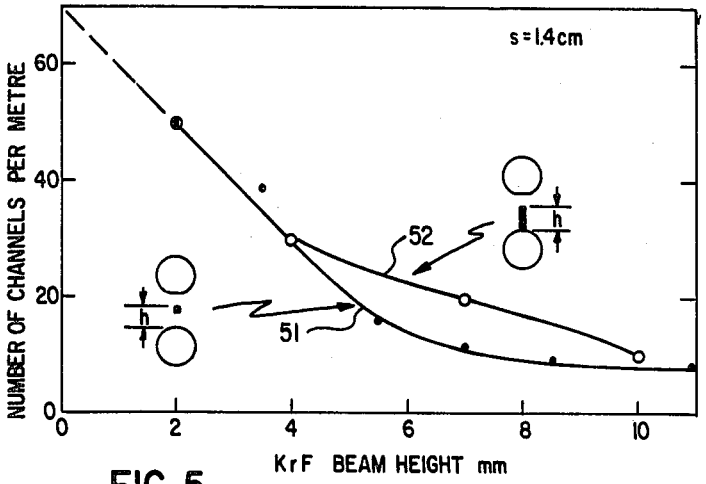
FIG. 5 illustrates the effects of beam positioning in the switch.
Figure 6:
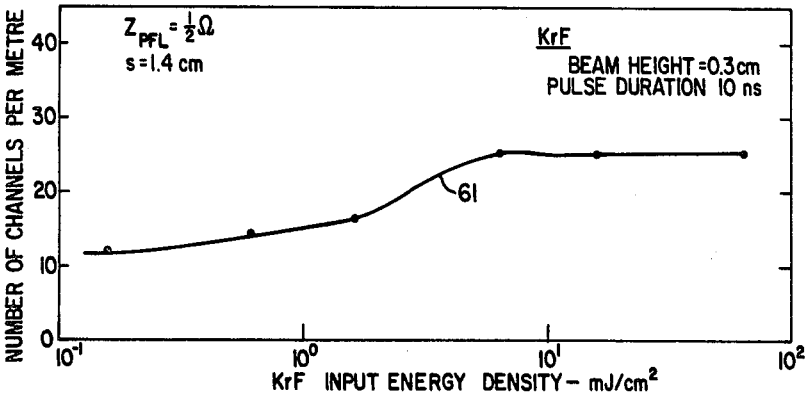
FIG. 6 illustrates the effects of beam energy density in the switch.

As mentioned above, it has been determined that the UV radiation beam 38 should be positioned near the positively stressed or positive ground electrode 32. For best performance, this distance is typically <20% of the electrode separation s. In FIG. 5, the distance h in mm of the upper edge of the KrF UV beam from the positive electrode is plotted versus the number of channels obtained per meter of electrode length in a switch in which the positive electrode has an f factor greater than the negative electrode, the distance s between electrodes is 1.4 cm and the beam width is 2 mm with an intensity of $2\times10^6$ W/cm$^2$. For curve 51, the beam cross-section is maintained constant at a height of 2 mm, and curve 51 is plotted as the beam is moved away from the positive electrode. For curve 52, the beam cross-section is varied by increasing the beam height. It is noted from these curves that the number of channels does not increase with an increase in beam area and that as the distance h increases, the number of channels decreases in both cases, indicating the importance of irradiating near but not necessarily touching the positive electrode. FIG. 6 illustrates a graph 61 of the number of channels produced/meter versus the energy density in mJ/cm$^2$ of a UV beam with a height of 0.3 cm in an electrode system having a gap of 1.4 cm. It is to be noted that the number of channels increases at low energy densities and then levels off at a relatively low energy density level, i.e. 10 mJ/cm$^2$ in FIG. 6,. This leveling off of the number of channels at this relatively low energy level indicates that the switch performance can be made insensitive to rather large variations in beam energy.

The main requirements of the UV beam in the rail-gap switch are that its cross-section remains substantially uniform along the length of the electrodes and that it have a fast risetime preferably <5 ns. It should be of sufficiently short wavelength to initiate significant ionization in the gas medium. This beam may be produced either as hard UV by a corona discharge source or, as soft UV by a UV laser.

Figure 7:
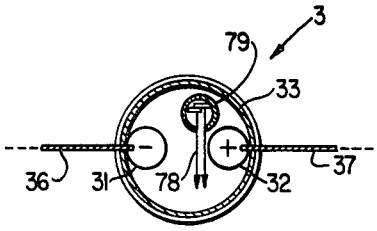
FIG. 7 illustrates an incoherent radiation triggered switch.
Figure 8:
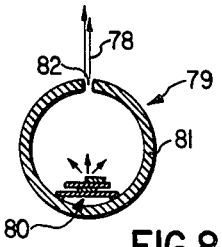

FIG. 7 illustrates, in cross-section, a rail-gap switch triggered by a corona source of the type described with respect to FIGS. 8 to 10. The switch 3 includes the hermetic enclosure 33 which houses the electrodes 31 and 32 and contains the appropriate gas mixture. The incoherent UV beam 78, which is generated by the corona discharge source 79, is collimated and is uniform along its cross-section. The UV source 79 shown in FIG. 8, consists of a corona source 80 supported and enclosed within a glass tube 81 which blocks or absorbs UV and which has a narrow slot 82 on the order of 1 mm to produce a laminar beam 78 of UV radiation. The corona discharge source 80, shown in FIGS. 9 and 10, is formed as a capacitance element from two conductive strips 83 and 84, such as copper, which are offset from one another along their width and which sandwich a thin dielectric sheet 85, such as mylar. This structure sits on a further dielectric 86 which is fixed within the glass tube 81. The conductive strips 83 and 84 are connected through a switch 89 to a small capacitor 87 which is charged from a dc source 88. At a predetermined time, the capacitor is discharged by a thyratron switch 89 or spark gap to produce a fast and very uniform burst of UV radiation which is emitted from the copper-mylar interface. The copper strips may be on the order of 0.125 mm thick, while the mylar sheets would be on the order of 0.375 mm thick. For this type of devices, the charging voltage from the dc source 88 was typically 10 kV.

FIG. 11 illustrates a rail-gap switch 3 triggered by a laser source 113. The switch 3 includes the hermetic enclosure 33 with end walls 34 and 35 which houses the electrodes 31 and 32 and contains the appropriate gas mixture. The coherent UV beam 114 is generated by a laser source 113 and is directed through the switch 3 via quartz windows 111 and 112. The beam 114 which has a uniform cross-section along its length is parallel to the electrodes 31 and 32 and near the positive electrode 32. The laser 113 may be a rare gas halide laser, such as an ArF, KrF or XeCl laser, operating at wavelengths of 193 nm, 248 nm, or 308 nm, respectively, or any other suitable laser such as an $N_2$ laser.

When using lasers which emit soft UV radiation, i.e. $\lambda \geqq 1900$ å; as UV sources, it is preferred to include in the gas mixture an organic additive in small concentrations of up to 100 parts per million to enhance the initial ionization yield. The organic additive should be matched to the UV radiation wavelength in order to optimize two-step photoionization which would result in the production of a large number of initial electrons. For example, the use of fluorobenzene together with a KrF laser results in improved switch performance. This two-step photoionization provides a sufficient level of ionization without unduly attenuating the transmission of the radiation through the gas in the switch.

As described above, the electrodes in the switch will have a cross-sectional profile having a field enhancement factor, f, of less than 1.5. These electrodes may be identical in size and shape, having, for example, a circular cross-section of equal radius, as generally shown in the previous figures. However, in order to produce electrodes with different field enhancement factors, f, the simplest construction would be to have circular cross-section electrodes having different radii, the larger radius electrode having an f smaller than the smaller radius electrode. Such a pair of electrodes is shown in FIG. 12, where electrode 121 has a radius $r_{121}$ which is smaller than the electrode 122 radius $r_{122}$.

To obtain an electrode having an f approaching 1.0 would require that the electrode radius be very large, or that the curvature of the face of the electrode be effectively circular with a large radius. This may be approximated by providing an electrode having a relatively flat face as shown in FIG. 13, where electrode 131 is circular in cross-section while electrode 132 is generally circular with a flattened area facing electrode 131. In this case, though electrode 132 is no bigger than electrode 131, its effective f can be made smaller than the f for electrode 131.

As described above, it has been determined that best results, i.e. high number of channels/meter, occur when the UV beam is near the electrode which is positive relative to the other electrode. It has been further determined that best results occur when the positive electrode, i.e. the positively stressed or the positive ground electrode, has an f greater than the f of the other electrode. The f for the positive electrode should preferably be in the range of 1.2 to 1.5, while the f for the negative electrode should preferably be in the range of 1.06 to 1.2.

One switch 3, shown in FIG. 11, constructed in accordance with the present invention included a pair of solid brass electrodes 31 and 32 which were 65 cm long. Electrode 31 had a flattened surface facing electrode 32, resulting in an effective f of approximately 1.1. The f for electrode 32 was approximately 1.3. The electrode 31 was negatively pulse charged from a source 2 that included a pulse forming network consisting of a three element distilled water dielectric transmission line energy storage element with a characteristic impedance $Z_o$ of approximately 1Ω. The pulse forming network was charged up to ~80 kV in a charging time of approximately 2 μs. Electrode 32 was connected to a copper sulphate liquid resistor matched load of approximately 1Ω. The enclosure 33 was filled with a gas mixture consisting of 50% Ar, 49% $N_2$ and 1% $SF_6$.

In the absence of UV triggering, no breakdown of the gap occurs between electrodes 31 and 32. The resulting voltage on the pulse forming network is shown as broken line 21 on FIG. 2. As described above, triggering may be achieved either by a narrow incoherent UV beam produced by a corona source or by a UV laser.

It is to be further noted in FIG. 2 that it is desired to have the control circuit 4 operate to provide a UV radiation pulse at or close to the time T when the maximum voltage is applied to the electrodes 31 and 32.

Figure 14:
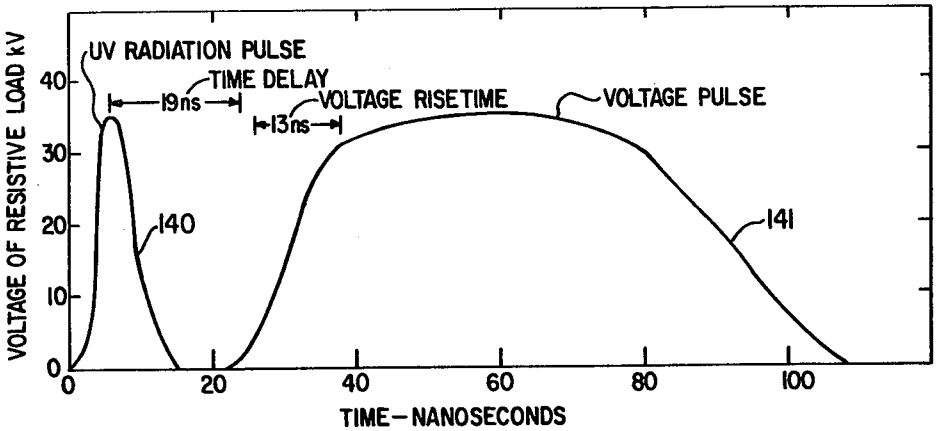
FIG. 14 illustrates the time sequence of the UV radiation pulse and the load voltage for a corona triggered switch.

In the case when an incoherent UV beam source was used, the gap between electrodes 31 and 32 was set at 1.4 cm and the gas pressure was set at 1.5 atmospheres. The pulsed UV beam 78 had a cross-section of $0.1 \times 50$ $cm^2$ produced by a corona source of the type described with respect to FIG. 8. The pulse duration of the beam was approximately 5 ns. When the switch was triggered by the incoherent UV radiation at time T, multichannel breakdown of the gap occurred as represented by line 22 in FIG. 2, showing an immediate voltage drop across the electrodes 31 and 32. This breakdown was visually observed to occur with up to 30 channels per meter. As shown in FIG. 14, the initiation of the voltage pulse, represented by 141, across the load 1 is delayed 19 ns from the peak of the UV radiation pulse 78, represented by 140, and the voltage pulse rise time is approximately 13 ns. The jitter between the UV radiation pulse and the voltage pulse is $\leqq 1$ ns.

Figure 15:
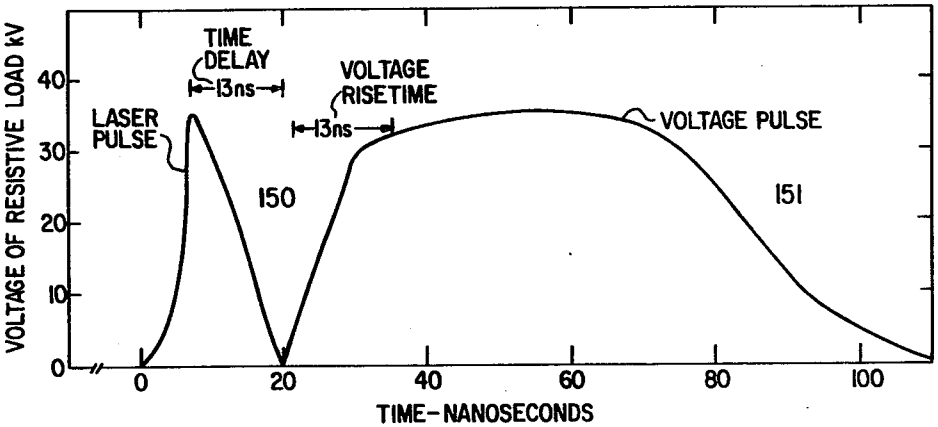
FIG. 15 illustrates the time sequence of the UV radiation pulse and the load voltage for a laser triggered switch.

In the case when a UV laser source was used, gap separations of 0.7 cm and 1.4 cm between electrodes 31 and 32 were set. For a fixed gas mix and pressure, the voltage hold-off of the switch scaled with the gap separation. At the 0.7 cm separation, a hold-off of 40 kV could be doubled by doubling the gas pressure from 1.5 to 3 atmospheres. The pulsed laser beam 114 was produced by a KrF laser having a wavelength of 2486 Å, a pulse duration of ~15 ns and a laser energy of 100 mJ. The unfocussed laser beam was apertured to produce a beam cross-section of $1.0\times1.0$ mm$^2$. With the passage of UV radiation from the KrF laser through the rail-gap (s=0.7 cm) containing a 3 atm. 50% Ar, 49% $N_2$ and 1% $SF_6$ gas mixture, at or close to a time T, corresponding to the maximum voltage on the pulse forming network, multchannel breakdown of the gap occurred as represented by line 22 in FIG. 2. This breakdown was visually observed to occur with up to 70 channels per meter. As shown in FIG. 15, the initiation of the voltage pulse, represented by 151, across the load 1 is delayed 13 ns from the peak of the laser pulse 114, represented by 150, and the voltage pulse rise time is approximately 13 ns. The jitter between the laser pulse and the voltage pulse is ≈300 picoseconds.

Many modifications in the above described embodiments of the invention can be carried out without departing from the scope thereof and, therefore, the scope of the present invention is intended to be limited only by the appended claims.

We claim:

1. A rail-gap switch for applying a voltage from a high voltage source to a low impedance load comprising:

first and second parallel elongated electrodes spaced to have an essentially constant width s gap between the electrodes, the gap having a gap length along the electrodes substantially greater than the gap width between the electrodes, the first electrode adapted to be connected to the high voltage source and the second electrode adapted to be connected to the low impedance load whereby one of the electrodes is positive with respect to the other electrode, the electrodes each having a cross-section providing a field enhancement factor $f\leqq1.5$;

enclosure means, the electrodes being located within the enclosure means, and the enclosure means containing a gas mixture for maintaining a voltage holdoff between the electrodes; and UV radiation source means for directing a narrow uniform cross-section beam of radiation in the gap along the gap length at a distance less than 0.2s from the positive electrode and substantially parallel to the pair of electrodes for initiating multichannel breakdown along the length of the gap between the electrodes.

2. A rail-gap switch as claimed in claim 1 wherein one electrode has a field enhancement factor, f, greater than the other electrode.

3. A rail-gap switch as claimed in claim 1 wherein the positive electrode has a field enhancement factor, f, greater than the other electrode.

4. A rail-gap switch as claimed in claim 1 wherein the radiation beam is directed near the positive electrode.

5. A rail-gap switch as claimed in claim 4 wherein one electrode has a field enhancement factor, f, greater than the other electrode.

6. A rail-gap switch as claimed in claim 4 wherein the positive electrode has a field enhancement factor, f, greater than the other electrode.

7. A rail-gap switch as claimed in claim 1 or 3 wherein the positive electrode is stressed by connection to a positive voltage source.

8. A rail-gap switch as claimed in claim 1 or 3 wherein the positive electrode is connected to positive ground through the load.

9. A rail-gap switch as claimed in claim 1 or 3 wherein the electrodes have a circular cross-section.

10. A rail-gap switch as claimed in claim 1 or 3 wherein one of the electrodes has a circular cross-section.

11. A rail-gap switch as claimed in claim 2 or 5 wherein $1.2\leqq f\leqq1.5$ for one electrode, and $1.06\leqq f\leqq1.2$ for the other electrode.

12. A rail-gap switch as claimed in claim 1 or 3 wherein $1.2\leqq f\leqq1.5$ for the positive electrode, and $1.06\leqq f\leqq1.2$ for the other electrode.

13. A rail-gap switch as claimed in claim 1 wherein the UV radiation source means is an incoherent radiation source.

14. A rail-gap switch as claimed in claim 13 wherein the incoherent radiation source is located within the enclosure means and includes corona discharge means for producing UV radiation and housing means having an aperture positioned about the corona discharge means thereby producing a narrow UV radiation beam.

15. A rail-gap switch as claimed in claim 1 wherein the UV radiation source means is a coherent radiation source.

16. A rail-gap switch as claimed in claim 15 wherein the coherent radiation source is a pulsed UV laser.

17. A rail-gap switch as claimed in claim 16 wherein the UV laser is selected from the group consisting of an ArF laser, KrF laser, XeCl laser or $N_2$ laser.

18. A rail-gap switch as claimed in claim 1, 13 or 14, wherein the gas mixture includes Ar, $N_2$, and $SF_6$.

19. A rail-gap switch as claimed in claim 15, 16 or 17, wherein the gas mixture includes Ar, $N_2$, and $SF_6$.

20. A rail-gap switch as claimed in claim 15, 16 or 17, wherein the gas mixture includes Ar, $N_2$, $SF_6$ and an organic additive.

21. A rail-gap switch as claimed in claim 1, 13 or 15 wherein the gas mixture includes Ar, $N_2$ and $SF_6$ in a ratio in the order of 1:1:0.02 and at a pressure between 1.5 and 3.0 atmospheres, and the gap between the electrodes is between 1.4 and 0.7 cm.

22. A rail-gap switch as claimed in claim 1, 13 or 15 in which the UV radiation source provides a beam having a rise time <5 ns.

23. A rail-gap switch for applying a preselected maximum voltage from a high voltage source to a low impedance load comprising:

first and second parallel elongated electrodes spaced to have an essentially constant width s gap between the electrodes, the gap having a gap length along the electrodes substantially greater than the gap width between the electrodes, the first electrode adapted to be connected to the high voltage source and the second electrode adapted to be connected to the low impedance load whereby one of the electrodes is positive with respect to the other electrode, the electrodes each having a cross-section providing a field enhancement factor, $f\leqq1.5$;

enclosure means, the electrodes being located within the enclosure means, and the enclosure means containing a gas mixture at a preselected pressure for maintaining a voltage holdoff between the electrodes in order to prevent breakdown in the switch unless triggered; and UV radiation source means for directing a narrow uniform cross-section beam of radiation in the gap along the gap length at a distance less than 0.2s from the positive electrode and substantially parallel to the pair of electrodes for triggering multichannel breakdown along the length of the gap between the electrodes.

24. A rail-gap switch as claimed in claim 23 wherein the UV radiation source means is a pulsed incoherent radiation source.

25. A rail-gap switch as claimed in claim 23 wherein the UV radiation source means is a pulsed coherent radiation source.

26. A rail-gap switch as claimed in claim 23, 24 or 25, wherein the UV radiation source means includes control means for coinciding the UV radiation pulse with the preselected maximum voltage across the electrodes.

27. A rail-gap switch as claimed in claim 23, 24 or 25 in which the pulse UV radiation source means provides a beam having a rise time $<5$ ns.

* * * * *